United States Patent [19]

Hori et al.

[11] 4,003,518

[45] Jan. 18, 1977

[54] METHOD AND DEVICE FOR CONTROLLING COMBUSTION IN LIQUID FUEL BURNER UTILIZING ULTRASONIC WAVE TRANSDUCER

[75] Inventors: Makoto Hori, Nara; Nerumitu Rokudo; Toshiyuki Ishiguro, both of Yamato-Koriyama, all of Japan

[73] Assignee: Matsushita Electric Industrial Co., Ltd., Japan

[22] Filed: Feb. 4, 1974

[21] Appl. No.: 439,002

Related U.S. Application Data

[63] Continuation of Ser. No. 283,200, Aug. 23, 1972, abandoned.

[30] Foreign Application Priority Data

Aug. 25, 1971 Japan ..... 46-65323
Apr. 25, 1972 Japan ..... 47-41982

[52] U.S. Cl. ..... 239/4; 239/102; 259/DIG. 44

[51] Int. Cl.[2] ..... B05B 3/14; B05B 17/06

[58] Field of Search ..... 239/4, 102; 259/DIG. 44

[56] References Cited

UNITED STATES PATENTS

| | | | |
|---|---|---|---|
| 2,855,244 | 10/1958 | Camp | 239/102 |
| 3,155,141 | 11/1964 | Doyle et al. | 239/102 X |
| 3,209,447 | 10/1965 | Jones | 239/102 X |
| 3,214,101 | 10/1965 | Perron | 239/102 |
| 3,275,059 | 9/1966 | McCullough | 239/4 X |
| 3,374,953 | 3/1968 | Bodine | 239/4 X |
| 3,398,944 | 8/1968 | Boucher | 239/102 X |
| 3,400,892 | 9/1968 | Ensminger | 239/4 X |
| R25,744 | 3/1965 | Drayer | 239/102 X |

FOREIGN PATENTS OR APPLICATIONS

| | | | |
|---|---|---|---|
| 22,480 | 10/1963 | Japan | 239/102 |

*Primary Examiner*—Robert S. Ward, Jr.
*Attorney, Agent, or Firm*—Burgess Ryan and Wayne

[57] ABSTRACT

In a liquid fuel burner of the type utilizing a liquid fuel atomizer comprising a hollow horn which is oscillated at an ultrasonic frequency by a transducer and includes a nozzle, the ratio of the area of the end surface of the nozzle or atomizing surface to the area of the nozzle opening is determined depending upon the properties of liquid fuel to be used.

3 Claims, 7 Drawing Figures

METHOD AND DEVICE FOR CONTROLLING COMBUSTION IN LIQUID FUEL BURNER UTILIZING ULTRASONIC WAVE TRANSDUCER

This is a continuation, of application Ser. No.283,200, filed Aug. 23, 1972 Priority is requested under 35 USC 119 based upon Japanese Appln. Nos. 65323/1971 filed Aug. 25, 1971 and 41982/1972 Filed Apr. 25, 1972.

BACKGROUND OF THE INVENTION

The present invention relates to a liquid fuel burner of the type utilizing a liquid fuel atomizer comprising a hollow horn which is oscillated at an ultrasonic frequency and includes a nozzle.

In the liquid fuel burner of the type described above, the liquid fuel atomizing surface at one end of the hollow horn is oscillated at an ultrasonic frequency, and liquid fuel forms a very thin film over the atomizing surface under the influence of surface tension of fuel oil. The thin fuel film is broken into finely divided particles as the atomizing surface oscillates at an ultrasonic frequency. In the liquid fuel atomizing method utilizing the ultrasonic wave energy, the degree of atomization is greatly dependent upon the diameter of the nozzle, the quality of the thin oil film and the area of the atomizing surface. When the above three conditions are not satisfied, the power input to the atomizer must be increased regardless of the flow rate of fuel oil. When the finely divided particles are large in size and if the atomization is not uniform, not only is the combustion efficiency lowered but also the breakdown of the atomizer occurs due to the thermal stress, thus resulting in a short service life.

SUMMARY OF THE INVENTION

Briefly stated, according to the present invention the ratio of the area of the end surface of the nozzle of the hollow horn, which is oscillated at an ultrasonic frequency by an ultrasonic wave transducer, to the area of the nozzle opening is determined depending upon the qualities of liquid fuel to be used.

One of the objects of the present invention is to provide a liquid fuel burner which may atomize completely the supplied liquid fuel, thus increasing the combustion efficiency.

Another object of the present invention is to provide a liquid fuel burner having a high liquid fuel atomization efficiency with respect to the power input applied to an ultrasonic wave generator.

The above and other objects, features and advantages of the present invention will become more apparent from the following description of one preferred embodiment thereof taken in conjunction with the accompanying drawing.

DESCRIPTION OF THE PREFERRED EMBODIMENT

Figure 1:
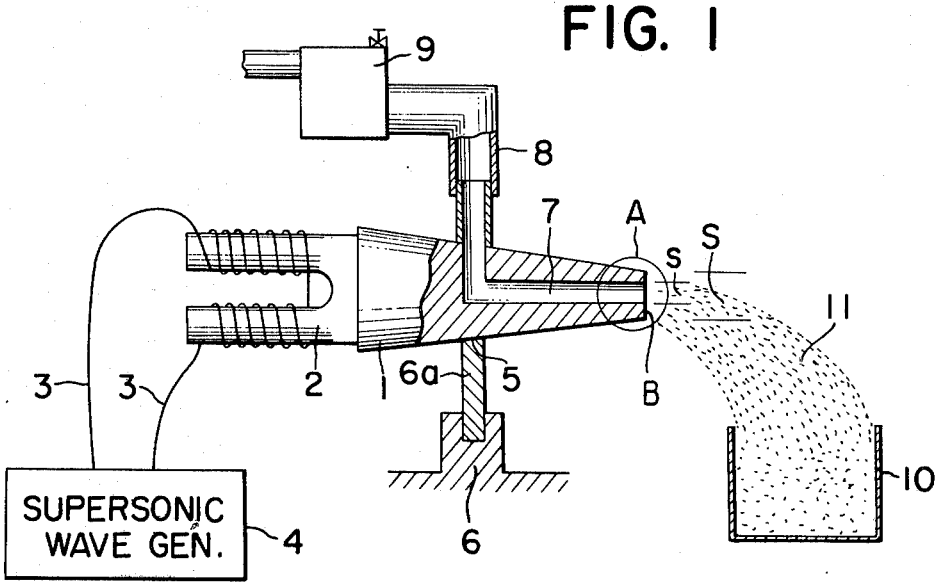
FIG. 1 is a side view, partly in section, of a liquid fuel burner used in the experiments conducted by the inventor for the purpose of determining the optimum ratio of the area of the end surface or atomizing surface of the nozzle to the area of the nozzle opening for optimum atomization to fuel oil.

Referring to FIG. 1 illustrating a liquid fuel burner used in the experiments, an ultrasonic wave generator 4 is coupled through a lead wire 3 to a transducer 2 to, one end of which is attached a hollow horn 1 for amplifying the amplitude of the ultrasonic oscillation. The hollow horn 1 is horizontally supported by a supporting member 6a which is fixed to the hollow horn 1 at a node 5 thereof at which the amplitude is zero, and the supporting member 6a in turn is fixed to a base 6. An oil supply line 7 extends horizontally coaxially of the hollow horn 1 and is bent upwardly at a right angle at the node 5 so as to extend through the hollow horn 1 and to be connected to an oil supply pipe 8 which in turn is connected to an oil regulator 9 connected to an oil reservoir or the like (not shown). Finely divided particles 11 of liquid fuel atomized at the front end or atomizing surface of nozzle A of the hollow horn 1 were collected into a container 10. The area of the nozzle opening is denoted by s whereas the area of the nozzle end (the area of the nozzle opening s + the area of atomizing surface), by S.

Various types of the nozzles A are illustrated in FIG. 2A to FIG. 2E. The nozzle shown in FIG. 2A has a large ratio S/s whereas the nozzle shown in FIG. 2B has a small ratio S/s. The nozzle shown in FIG. 2C has a flat end; the nozzle shown in FIG. 2D, an outwardly concaved end; and the nozzle shown in FIG. 2E, an inwardly concaved end. It is seen that depending upon the configurations of the nozzle ends, the area S varies, but the liquid fuel atomizing ability of the nozzle will be expressed in terms of S/s in this specification.

Next the mode of operation of the liquid fuel burner of the type described with reference to FIG. 1 will be described. The flow rate of the fuel oil flowing through the oil pipe 8 and the oil line 7 to the nozzle A is controlled by the oil regulator 9, and the oil reaching the nozzle A forms a thin film upon the atomizing surface B under the surface tension of fuel oil. Since the atomizing surface of the nozzle A is oscillating at an ultrasonic frequency, the thin oil film is atomized into finely divided particles 11.

Figure 2A:
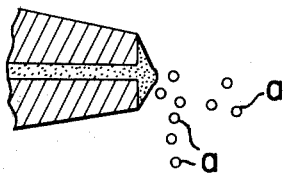
FIGS. 2A and 2B are sectional views of nozzles used for explanation of the difference in liquid fuel atomization due to the difference in the area of the nozzle opening.
Figure 2B:
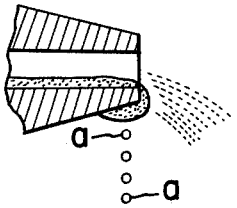
Figure 2C:
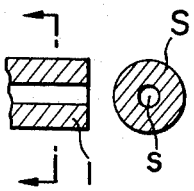
FIGS. 2C – 2E are longitudinal sectional views and sectional views of various nozzles used in the present invention.
Figure 2D:
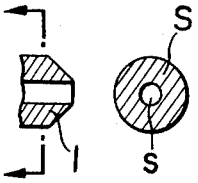
Figure 2E:
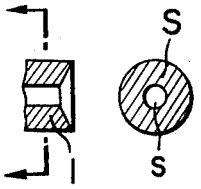

However, the atomizing ability of the nozzle A is dependent upon the ratio of S to s. When the ratio S/s is large because the nozzle opening s is small as shown in FIG. 2A, and if a large quantity of result, oil is supplied at a high flow rate, the oil will not form a uniform thin film upon the atomizing surface, but will form a small pool of oil at the center of the nozzle so that the oil dripping phenomenon occurs as shown by a in FIG. 2A. On the other hand, when the ratio S/s is small because the nozzle opening s is large as shown in FIG. 2B, the nozzle opening is not filled with oil so that a rather thick oil film is formed only on the lower half of the atomizing surface. As a result even if the power is increased, the thick oil film will not be atomized sufficiently, and a part of the oil film drips as indicated by a in FIG. 2B.

When the ratio S/s is not suitable, the thickness of the oil film formed upon the atomizing surface B is not uniform so that the atomizing ability is adversely affected and the large oil particles drip. When the fuel oil is for example kerosene, poisonous carbon monoxide is produced because of the slow evaporation rate of large kerosene particles. Furthermore the pulsating combustion occurs because of the non-uniform flame propagation rate.

Figure 3:
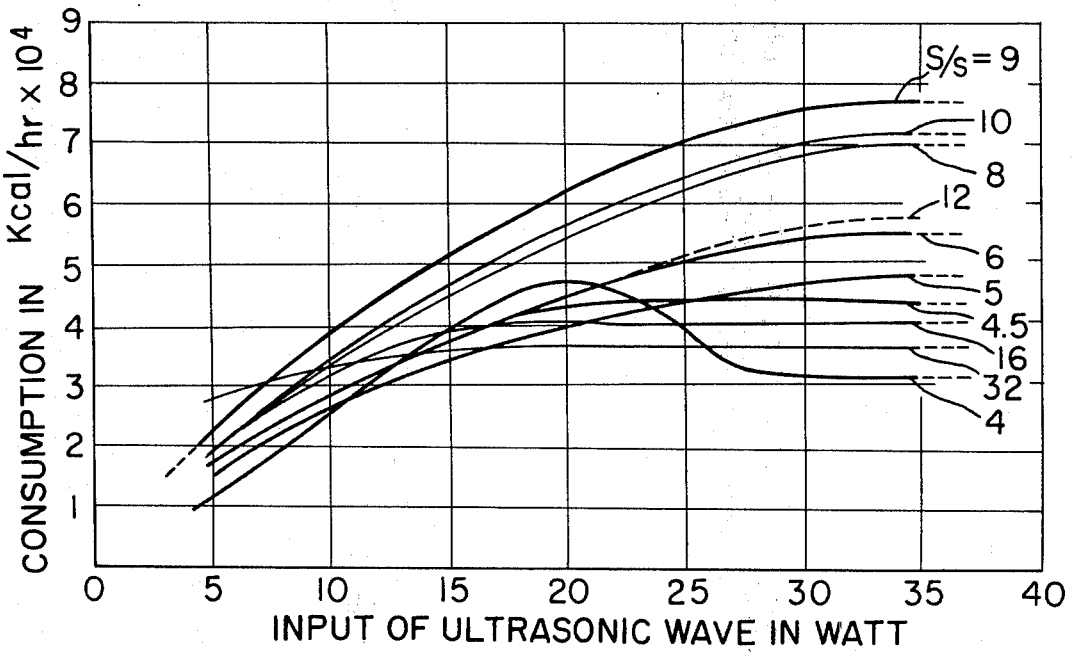
FIG. 3 is a graph illustrating the relation between the power input in watt to the ultrasonic wave generator and the fuel combustion rate in Kcal/hr when the above ratio is varied.

The inventor conducted the experiments using the fuel burner shown in FIG. 1 and kerosene in order to obtain the relation between the input in watts to the ultrasonic wave generator and the combustion rate in Kcal/hr when the ratio S/s is varied. The experimental results are shown in FIG. 3. In the experiments, the atomized particles 11 were collected in the container 10 in order to measure how much kerosene in cc (cubic centimeter) may be atomized per unit hour, and the volume of the atomized particles collected was mutiplied by the calorific value of kerosene of 8,150 Kcal/-liter. Except in those cases where S/s equals 4, 16 and 32, no oil dripping phenomenon was observed.

For the experiments on the structure of FIG. 1 the table given below shows each diameter D and d of respective atomizing surfaces and nozzle openings.

| S/s | D in mm | d in mm |
|---|---|---|
| 4 | 10 | 5 |
| 4.5 | 10.6 | 5 |
| 5 | 10 | 4.5 |
| 6 | 9.8 | 4 |
| 8 | 11.4 | 4 |
| 9 | 12 | 4 |
| 10 | 12.55 | 4 |
| 12 | 12 | 3.5 |
| 16 | 8 | 2 |
| 32 | 11.4 | 2 |

As seen from FIG. 3, when the ratio S/s is equal to 16 and 32 the flow rate of kerosene in the fuel line 7 becomes too fast if the supply of kerosene is increased, so that kerosene is pushed forward at the atomizing surface of the nozzle A before the thin oil film is formed and atomized, thus resulting in the oil dripping. When S/s is equal to 4, that is the nozzle opening area g is too large, kerosene forms on the film only over the lower half of the atomizing surface of the nozzle A under the influence of the gravity so that if the flow rate is increased, the thickness of the oil film is increased as the atomizing surface is too small. As a result a part of supplied kerosene is not atomized and drips even if the input is increased. When the input is increased beyond a certain range, the atomized particles are increased in particle size so that the combustion efficiency is lowered. In order to prevent the increase in particle size of the atomized particles, the supply of kerosene must be reduced so that the atomized particles is inevitably reduced in quantity.

When the ratio S/s is increased from 4 to 4.5, 5, 6, 8 and 9 the combustion rate is gradually increased, but when the ratio S/s is increased to 10, 12, 16 and 32, the combustion rate is decreased. When the ratio S/s is in the range between 4.5 and 16, the combustion rate is gradually increased as the input is increased so that the ratio S/s may have any value within this range. However, the dimensions of the hollow horn are preferably small so that it may be easily oscillated at an ultrasonic frequency. As a result, the most preferable range is between 5 and 9. From the technical stand point, it is considered that the relation similar to that shown in FIG. 3 will be attained even if the ratio S/s changes within ±5%.

The relation similar to that shown in FIG. 3 is obtained when other liquid fuel such as heavy oil is used. First the viscosity of heavy oil is greater than that of kerosene so that when the ratio S/s is higher than 36, it cannot spread over the atomizing surface to form a uniform thin oil film. As a consequence, the heavy oil film only in a very limited area adjacent to the nozzle opening is atomized, and if the flow rate is increased the thickness of the oil film is increased, so that the input must be increased accordingly. When the flow rate exceeds a certain point, the oil dripping occurs regardless of the input to the ultrasonic wave generator, so that the oil drops are mixed with finely atomized particles, thus resulting in the decrease in combustion efficiency as in the case of kerosene fuel.

On the other hand, when the ratio S/s is smaller and is for example between 6 and 4 and less, heavy oil will not fill the fuel line 7 sufficiently because the specific weight of heavy oil is greater than that of kerosene so that heavy oil flows only along the lower half of the inner wall of the fuel line 7 and forms the oil film only at the lower half of the atomizing surface of the nozzle. As a result, the atomized heavy oil particles are concentrated only in the lower portion, and are not mixed with air uniformly. Furthermore the input is wasted and the thickness of the oil film along the outer periphery of the atomizing surface is increased so that the oil drops drip.

From the foregoing description it is seen that according to the present invention the ratio S/s is suitably selected so that the combustion efficiency of a burner of the type utilizing a hollow horn which is oscillated at an ultrasonic frequency may be improved whereas the input to an ultrasonic wave generator is decreased. Since the high combustion efficiency may be attained with a low input, the problems caused by the heating of the ultrasonic wave generator and the transducer may be overcome.

In this specification, the relation between the area of the end surface of the nozzle and the nozzle opening area is expressed in terms of S/s, but it will be understood that the relation may be expressed in terms of the radii or diameters of the end surface of the nozzle and the nozzle opening.

What is claimed is:

1. A method for controlling the combustion in a liquid fuel burner of the type utilizing a liquid fuel atomizer comprising a hollow horn which is oscillated at an ultrasonic frequency and includes a nozzle, said method comprising the step of supplying kerosene to a nozzle having a ratio of the area of the end surface of said nozzle to the area of the nozzle opening of 4.5 to 9, thereby controlling the liquid fuel atomization conditions.

2. In a liquid fuel burner for kerosene of the type utilizing a liquid fuel atomizer comprising a hollow horn which is oscillated at an ultrasonic frequency and includes a nozzle, an improvement wherein the ratio of the area of the end surface of said nozzle to the area of the nozzle opening is in the range of 4.5 to 16, thereby controlling the liquid fuel atomization conditions.

3. A liquid fuel burner as set forth in claim 2 wherein said ratio is in the range of 5 to 9.

* * * * *

UNITED STATES PATENT OFFICE

CERTIFICATE OF CORRECTION

Patent No. 4,003,518 Dated January 18, 1977

Inventor(s) Makoto Hori, et al

It is certified that error appears in the above-identified patent and that said Letters Patent are hereby corrected as shown below:

Column 1, line 64: Change "to" to --of--.

Column 2, line 56: Change "result," to --fuel--.

Column 3, line 45: Change "g" to --s--.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*